US009126731B2

(12) United States Patent
Chen

(10) Patent No.: US 9,126,731 B2
(45) Date of Patent: Sep. 8, 2015

(54) SAFETY SEALED RESERVOIR CAP

(75) Inventor: Tei Fu Chen, Torrance, CA (US)

(73) Assignee: The Sunrider Corporation, Torrance, CA (US)

( * ) Notice: Subject to any disclaimer, the term of this patent is extended or adjusted under 35 U.S.C. 154(b) by 427 days.

(21) Appl. No.: 12/253,404

(22) Filed: Oct. 17, 2008

(65) Prior Publication Data

US 2009/0139951 A1 Jun. 4, 2009

Related U.S. Application Data

(60) Provisional application No. 60/982,582, filed on Oct. 25, 2007, provisional application No. 60/991,137, filed on Nov. 29, 2007.

(51) Int. Cl.

| | |
|---|---|
| ***B65D 25/08*** | (2006.01) |
| ***B65D 51/28*** | (2006.01) |
| *B65D 51/22* | (2006.01) |

(52) U.S. Cl.

CPC ..... *B65D 51/2835* (2013.01); *B65D 51/225* (2013.01); *Y10S 215/08* (2013.01); *Y10T 29/49945* (2015.01)

(58) Field of Classification Search

CPC ..... B65D 51/2821; B65D 51/2835; B65D 51/285; B65D 51/28; B65D 51/222; B65D 51/225; B65D 50/245; Y10S 215/08

USPC ..... 206/222, 0.5, 219; 215/227, 297; 222/83

See application file for complete search history.

(56) References Cited

U.S. PATENT DOCUMENTS

| | | | | |
|---|---|---|---|---|
| 1,059,101 | A | 4/1913 | Alston | |
| 3,603,469 | A * | 9/1971 | Magni | 206/222 |
| 3,802,604 | A * | 4/1974 | Morane et al. | 222/83 |
| 3,968,872 | A * | 7/1976 | Cavazza | 206/222 |
| 4,195,731 | A * | 4/1980 | Cavazza | 206/222 |
| 4,793,475 | A | 12/1988 | Itzel | |
| 4,982,875 | A | 1/1991 | Pozzi et al. | |
| 5,038,951 | A * | 8/1991 | Rizzardi | 215/256 |
| 5,543,097 | A * | 8/1996 | Fang | 264/102 |
| 5,782,345 | A * | 7/1998 | Guasch et al. | 206/222 |
| 5,927,549 | A * | 7/1999 | Wood | 222/83 |
| 6,045,254 | A * | 4/2000 | Inbar et al. | 366/130 |
| 6,138,821 | A | 10/2000 | Hsu et al. | |
| 6,148,996 | A * | 11/2000 | Morini | 206/222 |
| 6,412,526 | B2 * | 7/2002 | Castillo | 141/100 |
| 6,705,462 | B2 * | 3/2004 | Kasuya | 206/222 |

(Continued)

FOREIGN PATENT DOCUMENTS

| | | |
|---|---|---|
| CN | 1874954 A | 12/2006 |
| CN | 201587641 U | 9/2010 |

(Continued)

OTHER PUBLICATIONS

Office Action issued for related Australian Patent Application No. 2008317037, dated Dec. 21, 2012.

Office Action issued for related European Patent Application No. 08841569.0, dated Jul. 5, 2012.

Office Action issued for related Japanese Patent Application No. 2010-531142, dated Mar. 5, 2013, and its English summary, provided by foreign representative.

(Continued)

*Primary Examiner* — Fenn Mathew
*Assistant Examiner* — James N Smalley
(74) *Attorney, Agent, or Firm* — Ladas & Parry, LLP

(57) ABSTRACT

A sealed reservoir cap for attaching to a bottle includes an annular part slidably received into another annular part to define an enclosed reservoir there between that is closed off by a punchable seal.

21 Claims, 5 Drawing Sheets

(56) References Cited

U.S. PATENT DOCUMENTS

| | | | | |
|---|---|---|---|---|
| 6,705,490 | B1 * | 3/2004 | Lizerbram et al. | 222/145.1 |
| 6,705,491 | B1 * | 3/2004 | Lizerbram et al. | 222/145.1 |
| 6,786,330 | B2 * | 9/2004 | Mollstam et al. | 206/222 |
| 6,840,373 | B2 * | 1/2005 | Gibler et al. | 206/219 |
| 6,874,648 | B2 * | 4/2005 | Willingham et al. | 215/344 |
| 6,921,087 | B2 * | 7/2005 | Takahashi et al. | 277/628 |
| 6,976,578 | B1 * | 12/2005 | Kenihan | 206/222 |
| 6,986,345 | B2 * | 1/2006 | Kolb | 126/263.08 |
| 7,114,635 | B2 * | 10/2006 | Yamada | 222/83 |
| 7,249,690 | B2 | 7/2007 | Smith et al. | 222/83 |
| 7,337,921 | B2 | 3/2008 | Ma | |
| 7,347,322 | B2 | 3/2008 | Cho | 206/222 |
| 7,458,486 | B2 | 12/2008 | Weist et al. | |
| 7,562,782 | B2 | 7/2009 | Yorita | |
| 7,607,549 | B2 * | 10/2009 | Morini | 215/297 |
| 7,703,664 | B2 * | 4/2010 | Westphal et al. | 229/4.5 |
| 7,748,550 | B2 * | 7/2010 | Cho | 215/228 |
| 7,870,952 | B2 * | 1/2011 | Fontana | 206/222 |
| 7,874,420 | B2 * | 1/2011 | Coon | 206/219 |
| 2002/0096440 | A1 * | 7/2002 | Kasuya | 206/222 |
| 2003/0089627 | A1 | 5/2003 | Chelles | |
| 2003/0150748 | A1 | 8/2003 | Crawley | |
| 2003/0213709 | A1 * | 11/2003 | Gibler et al. | 206/219 |
| 2004/0020797 | A1 * | 2/2004 | Fontana | 206/219 |
| 2005/0145632 | A1 * | 7/2005 | Cocca et al. | 220/495.01 |
| 2005/0205438 | A1 * | 9/2005 | Hierzer et al. | 206/222 |
| 2005/0211579 | A1 | 9/2005 | Makita | 215/228 |
| 2006/0108314 | A1 * | 5/2006 | Cho | 215/228 |
| 2007/0045134 | A1 | 3/2007 | Dvorak | |
| 2007/0045217 | A1 | 3/2007 | Cho | 215/236 |
| 2007/0074979 | A1 | 4/2007 | Cho et al. | 206/219 |
| 2008/0023349 | A1 * | 1/2008 | Balazik | 206/222 |
| 2008/0125704 | A1 * | 5/2008 | Anderson | 604/87 |
| 2008/0171109 | A1 | 7/2008 | Hsieh | |
| 2009/0139951 | A1 * | 6/2009 | Chen | 215/227 |
| 2009/0308831 | A1 | 12/2009 | Anderson | |
| 2010/0116699 | A1 * | 5/2010 | Sorenson | 206/219 |
| 2013/0313138 | A1 * | 11/2013 | Thoman et al. | 206/222 |

FOREIGN PATENT DOCUMENTS

| | | | |
|---|---|---|---|
| JP | S50-42978 | | 4/1995 |
| JP | 2003-335351 | A | 11/2003 |
| JP | 2005-022706 | | 1/2005 |
| JP | 2006-056593 | A | 3/2006 |
| JP | 2007-076738 | | 3/2007 |
| JP | 2007-269403 | | 10/2007 |
| KR | 10-2005-019017 | A | 11/2005 |
| KR | 10-2005-0103807 | A | 11/2005 |
| KR | 10-2005-0106690 | A | 11/2005 |
| KR | 10-2005-0106990 | A | 11/2005 |
| KR | 10-2005-0109017 | A | 11/2005 |
| KR | 10-2006-0011756 | A | 2/2006 |
| KR | 10-2006-0028356 | A | 3/2006 |
| KR | 10-2006-0028365 | A | 3/2006 |
| TW | M289049 | | 4/2006 |
| WO | 98/38104 | A1 | 9/1998 |
| WO | WO 9838104 | | 9/1998 |
| WO | 2004/000667 | | 12/2003 |
| WO | 2005/044670 | A2 | 5/2005 |
| WO | WO 2005044430 | | 5/2005 |
| WO | 2006/046721 | A1 | 5/2006 |
| WO | 2009/031167 | | 3/2009 |
| WO | 2009/055311 | | 4/2009 |

OTHER PUBLICATIONS

Memo of Office Action issued for related Mexican Patent Application No. MX/a/2010/004166, dated Jan. 9, 2013.
English summary of Office Action issued for related Israeli Patent Application No. 205060, dated Nov. 13, 2012, provided by foreign representative.
Office Action issued for related Philippine Patent Application No. 1-2010-500855, dated Jul. 18, 2012.
Office Action issued for related Philippine Patent Application No. 1-2010-500855, dated Mar. 21, 2013.
Office Action issued for related Vietnamese Patent Application No. 1-2010-00965, dated Jul. 27, 2012 and English summary, provided by foreign representative.
International Search Report and Written Opinion for PCT Application No. PCT/US2008/080291 mailed on Dec. 29, 2008.
International Preliminary Report on Patentability for PCT Application No. PCT/US2008/080291 issued on Apr. 27, 2010.
Office Action for Australian Application No. 2008317037 dated Oct. 2, 2013.
Office Action for EPO Application 08841569.0 dated Mar. 27, 2014.
Office Action for Japanese Application No. 2010-531142 dated Dec. 13, 2013 and English translation provided by foreign representative.
English summary of Office Action for related Mexican Application No. MX/a/2010/004166 dated Aug. 29, 2013.
English summary of Office Action for related Mexican Application No. MX/a/2010/004166 dated Apr. 14, 2014.
Office Action for Philippine Application No. 1-2010-500855 dated Jul. 16, 2013.
Written Opinion and Search Report for Singapore Application No. 201002577- 3 dated Jun. 16, 2011.
Office Action for Singapore Application No. 201002577-3 dated Sep. 21, 2012.
Office Action for Singapore Application No. 201002577-3 dated Feb. 2, 2012.
International Search Report and Written Opinion for PCT Application No. PCT/US2012/052580 dated Feb. 19, 2013.
International Preliminary Report on Patentability for PCT Application No. PCT/US2012/052580 dated Mar. 4, 2014.
Office Action for Canadian Application No. 2,702,517 dated Mar. 31, 2014.
Office Action for related Malaysian Application No. PI2010001666 dated Mar. 14, 2014.
Office action from Israeli Patent Application No. 205060 dated Jul. 15, 2014, and its English translation.
Office action from Korean Patent Application No. 2010-7008247 dated Aug. 11, 2014, and partial English summary from foreign representative.
Office action from Philippine Patent Application No. 1-2010-500855 dated Aug. 19, 2014.
Office action from U.S. Appl. No. 13/595,984 dated Aug. 7, 2014.
Office action from U.S. Appl. No. 13/595,984 dated Mar. 25, 2015.
Office action from Korean Patent Application No. 2010-7008247 and its machine English translation (Adobe Acrobat 9, Google Translate).
Office action from Chinese Patent Application No. 201280041906.7 dated Apr. 29, 2015 with machine English translation and brief English summary (ABBYY PDF Transformer 3.0; Google Translate).
Office action from Philippine Patent Application No. Jan. 2010/500855 dated May 22, 2015.
Office action from Canadian Patent Application No. 2,702,517 dated Jun. 19, 2015.

* cited by examiner

SAFETY SEALED RESERVOIR CAP

BACKGROUND

The present writing relates to the field of beverages, and more specifically to a simplified chambered bottle cap that can store and dispense the cap's contents into a bottle containing a fluid. The present cap differs considerably from the following prior art: TW M289049, U.S. Pat. No. 7,249,690 and U.S. Publication No. 2005/0211579.

Bottled beverages, including water, soda, and juices, comprise a multibillion dollar industry worldwide. The primary container used for the storage and sale of such beverages is the plastic bottle. Plastic bottles have gained such widespread use for a variety of factors, including low cost, light weight, ease of use, and durability. Plastic bottles are usually closed at the top with a plastic cap, usually with a type of safety seal. The cap can be removed by twisting or flipping to expose the beverage inside the bottle. Often such caps comprise a movable valve such as a sports bottle cap, which allows a person to seal the bottle and to use the valve as a drinking aid similar to a straw.

Water-soluble drink mixes are in widespread commercial use. Often in tablet or powder form, these mixes allow consumers to create beverages by simply adding water. The consumer measures the indicated or desired amount of mix to water in order to produce a beverage. Such mixing is impractical with common plastic water bottles, as it is difficult to introduce a powder through a narrow opening. It may be easier to do this in the home (with the use of a small funnel), however, but it is quite difficult when traveling or during outdoor activities such as hiking. Furthermore, such "on the go" mixing requires that the consumer carry a separate bottle and drink mix. It is also easy to incorrectly measure the amount of water or drink mix and thus create a beverage that is either too concentrated or diluted.

It is well known in the art that beverage additives such as vitamins, nutrients, and other supplements are volatile when suspended in liquids such as water. The potency of such beverage additives decreases over time in water. As a result, beverage manufactures must "over fortify" such beverages by adding additional vitamins, nutrients, and other supplements to ensure a minimum potency level at consumption or expiration. This causes additional raw material expenses for beverage producers, significantly shortens beverage shelf life, and leaves consumers uncertain of the potency or nutritional value of such beverages.

The general concept of a bottle or container top comprising a storage reservoir for a beverage additive is well known in the art. Various means have been described in the art, however each suffers from one or more undesirable aspects, all of which the instant device has been designed in an attempt to overcome.

A first deficiency in the art is that such caps often comprise reservoirs of such shapes which comprise barriers or cavities which block the flow of additives into the bottle, resulting in waste and additional effort by the consumer to utilize all of the components of the beverage. It is further possible that some of the additives or the fluid can remain in the cap after discharge, thus resulting in a beverage that is too weak, or in the case of medication or nutrients, the incorrect dose or strength.

A second deficiency in the art is that such caps generally comprise separate reservoir compartments, thus requiring additional costs and materials for product.

A third deficiency in the art is that such caps generally comprise cutting or piercing devices which are of a complicated structure or operation. This increases the cost of production of the cap, and in some cases, the cutting or piercing devices are dangerously sharp.

A fourth deficiency in the art is that such caps generally comprise insufficient or non-existent tamper resistant features, exposing the beverage additive and/or fluid to tampering.

A fifth deficiency in the art is that such caps often comprise excessively large tamper resistant features which require substantially more materials to produce. This increases the amount of waste product and increases the costs of production.

A sixth deficiency in the art is that such caps often comprise insufficient mechanisms for preventing the premature release of contents of reservoir into the beverage, thus increasing the risk of prematurely adding the beverage additives to the fluid in the bottle.

A seventh deficiency in the art is that such caps often comprise large mechanisms for preventing premature release, increasing the bulk and cost of production of the cap.

An eighth deficiency in the art is that such caps generally comprise missing or inadequate systems for preventing water from leaking out through the cap when agitated, such as through transport, shaking or inadvertent mixing;

A ninth deficiency in the art is that such caps generally comprise more than two component pieces for the cap, which significantly increases the complexity and cost of producing, assembling, and using the bottle cap.

A tenth deficiency in the art is that such caps generally comprise a separate reservoir which must be pierced, which renders the cap design more complicated (and thus more expensive to build and assemble).

An eleventh deficiency in the art is that such caps generally are not intended to be capped when bottled, thus not available for long term storage/transport, requiring separate purchase and transport, and thus cannot be placed on bottle long term.

A twelfth deficiency in the art is that such caps generally comprise parts of the bottle cap mechanism which are designed to fall into the fluid, creating a choking and safety hazard as the beverage is consumed.

A thirteenth deficiency in the art is that such caps often require significant physical effort (e.g., strength or a mechanical device such as a bottle opener) to remove the cap.

A fourteenth deficiency in the art is that such caps generally do not comprise a seal between cap and bottle, thus providing a beverage which is easier to tamper with or otherwise adulterate.

A fifteenth deficiency in the art is that such caps generally comprise plunger/piercing mechanism which must break through a difficult seal, requiring significant force by the user to release the contents of the cap into the fluid container. This is unsuitable for weaker individuals such as children or the elderly.

The present writing describes embodiments that are hoped to overcome many if not all of these deficiencies in the art, and include the following additional features heretofore not disclosed in the art.

The present writing presents a reservoir bottle cap with a simplified design, relying upon only two pieces for a combined cap, reservoir, piercing mechanism, and safety seals. This simplified design requires substantially fewer raw materials in producing the cap, and is less complicated to assemble. Both of these factors reduce the cost of production for a reservoir bottle cap. Furthermore, the cap described in the present writing is likely easier for the consumer to use than the caps of the current art.

The cap of the present writing utilizes a combination reservoir and piercing mechanism, reducing the number of components required for assembling a final bottle cap.

A further achievement of the cap of the present writing is the utilization of three separate seals and/or locking mechanisms, which attempt to prevent tampering of the beverage additives and fluid as well as premature release of beverage additives into the fluid. The first is a combination pull tab lock/seal on the exterior surface of the cap, which holds the piercing mechanism in place, thus preventing its removal or accidental engagement of the piercing mechanism/reservoir. The second seal is located at the base of the bottle cap on the exterior surface of the bottle which prevents the cap from being removed prior to use. The third seal is located at the base of the bottle cap in the interior of the bottle, which prevents accidental discharge of the stored beverage additives, and protects them from spoilage by contact with the fluid or other environmental factors. Other caps known in the art comprise only one or two seals (including ones which can be accidentally broken or even resealed in a manner to disguise prior opening), thus allowing the bottle to be easily tampered with or the contents to be adulterated. The lock seal of the cap described in the instant writing makes it almost impossible to engage the plunger without removing the lock seal. Other caps known in the art require the user to apply more force to engage the mechanism to release the contents of the reservoir.

A further aspect of the cap of the instant writing is that the reservoir and piercing mechanism do not create cavities or empty areas where the stored material (or fluid from mixing/agitation) can remain lodged. This allows for additional ease of use (less vigorous shaking/mixing is required) and more accurate dosing of components stored in the reservoir.

The cap of the present writing further discloses a structure which is intended to prevent fluid from leaking up through the bottle cap. This structure differs from the current art, which generally requires that additional materials are utilized to form a type of wedge. When depressing the plunger on such devices, the plunger needs to be forced into a locked position to prevent fluid leaking up through the cap. The cap of the instant writing utilizes a method which requires significantly less force, yet results in a complete fluid barrier in the cap.

BRIEF SUMMARY

The present writing presents a reservoir bottle cap for beverage additives with a simplified design, relying upon two major pieces for a combined cap, reservoir and piercing mechanism. This simplified design requires substantially fewer raw materials in producing the cap, and is less complicated to assemble. The cap of the present writing includes a number of non limiting and different embodiments disclosing ways to combine and lock the two pieces together, as well a large variety of safety mechanisms which ensure that the beverage additives and bottled fluids are safely, sterilely, and securely sealed to prevent tampering, exposure, contamination, and other adulteration by the environment, the other beverage additives, or by individuals.

DETAILED DESCRIPTION

Definitions

Figure 1:
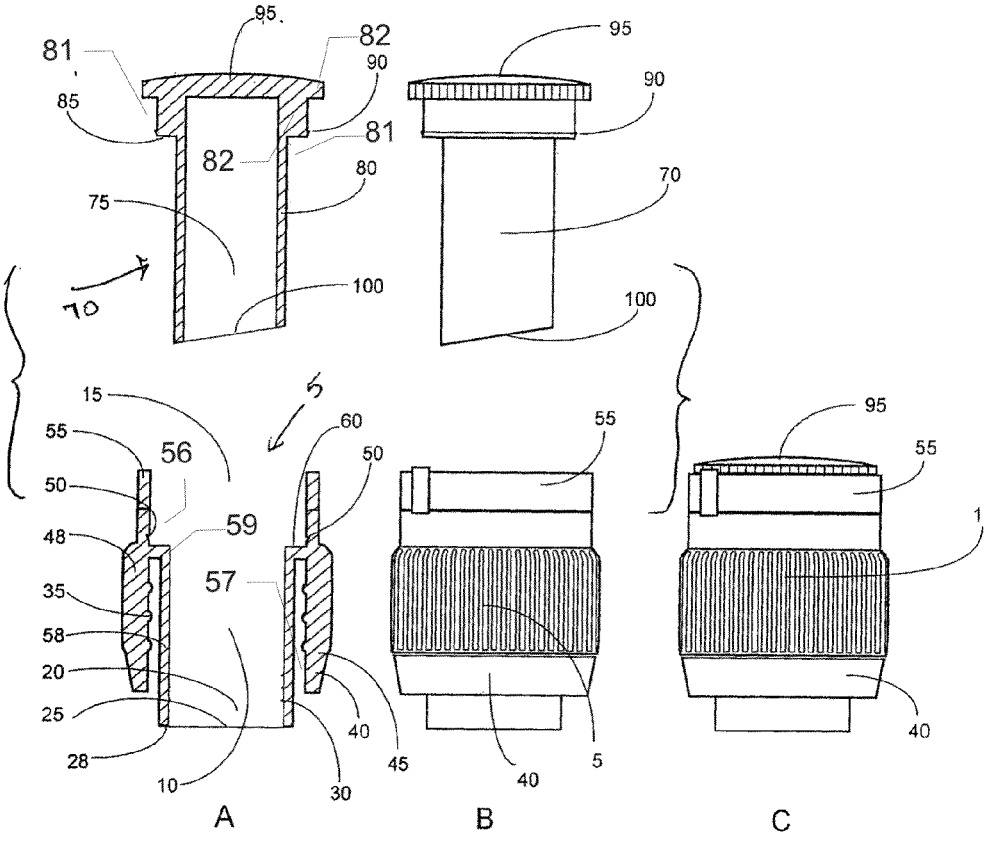
FIG. 1A is a cutaway exploded view of a first embodiment of the present writing, depicting the two pieces of the cap here disclosed.
FIG. 1B is an exploded outside perspective of a first embodiment of the present writing, depicting the two pieces of the cap of this writing.
FIG. 1C is an outside perspective of a first embodiment of the cap of the present writing, depicting the two pieces of the cap coupled together prior to engaging the piercing mechanism to release the beverage additives into the fluid.
FIG. 1D is a cutaway close perspective of a first embodiment of the cap of the present writing, depicting the two pieces of the cap coupled together and filled with beverage additives.
FIG. 1E is a cutaway view of a first embodiment of the cap of the present writing, depicting the two pieces of the cap coupled together, filled with beverage additives, placed atop a bottle prior to engaging the mechanism to release the beverage additives into a fluid.
FIG. 1F is a cutaway view of a first embodiment of the present writing, depicting the two pieces of the cap of the present writing coupled together, filled with beverage additives, placed atop a bottle, and engaged to break all seals and release the beverage additives into the bottle.
Figure 1:
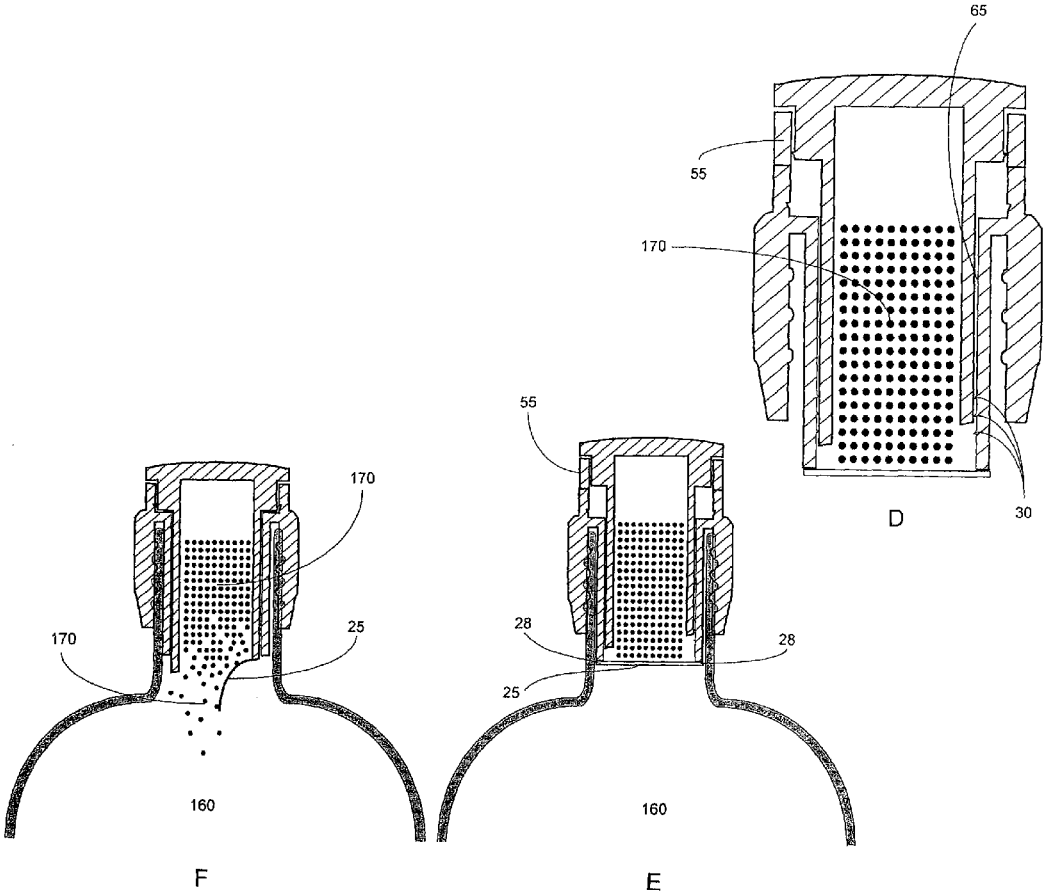

Unless defined otherwise, all technical and scientific terms used herein have the same meaning as commonly understood by one of ordinary skill in the art to which this writing belongs. Generally, the nomenclature used herein and the manufacturing procedures for the devices and components described below are well known and commonly employed in the art. Conventional methods are used for these procedures, such as those provided in the art and various general references. Where a term is provided in the singular, the inventor also contemplates the plural of that term. The terms top, bottom, lower, upper, up, down, into, out of, upwards, downwards, and other directional terms are not limiting and are used merely as points of reference, and as is clear in the disclosure and embodiments of the writing, alternative arrangements, alignments, and points of reference may be used. As employed throughout the disclosure, the following terms, unless otherwise indicated, shall be understood to have the following meanings (although obvious modifications are contemplated):

"Beverage additives" means vitamins, minerals, supplements, medications, medicines, drugs, amino acids, electrolytes, enzymes, nutrients, fiber, antioxidants, protein, food, vegetables, fruits, berries, plants, flowers, algae, nuts, herbs, teas, seeds, barks, roots, juices, leaves, trees, grasses, flavorings, sweeteners, beverage concentrates, chemical additives, coffee, caffeine, alcohol, all in powdered, fluid, or solid state;

"Bottle" means a portable container for holding fluids and liquids, characteristically having a neck and mouth and made of generally impermeable material such as but not limited to glass or plastic;

"Cap" means a protective cover or seal, especially one that closes off an end, opening or a tip of a bottle;

"Compartment" means a partitioned section or chamber within a larger enclosed area;

"Fluid" means any liquid or fluid substance, whether or not capable of consumption or ingestion by a human, including but not limited to water, juice, drinks, beverages, teas, chemicals, and solvents;

"Reservoir" means a receptacle or chamber for storing fluids, solids, or powders, comprising one or more separate receptacles or chambers for storing and keeping separate a plurality of fluids, solids, or powders; and "Seal" means a device or mechanism attached to or comprising an object, which must be broken when the object is opened, insuring that the contents have not been tampered with or altered;

Other technical terms used herein have their ordinary meaning in the art in which they are used, as exemplified by a variety of technical dictionaries.

The present writing discloses a safety sealed reservoir compartment bottle cap. The bottle cap is preferably comprised of two pieces (top piece and bottom piece) which interlockingly fit together. The bottom piece comprises a chamber for receiving the top piece, a bottom seal, a surface for securing to a screw top container, a screw top seal, and a lock seal. The top piece comprises a reservoir for receiving and storing beverage additives. The reservoir in the top piece is of a shape which allows the reservoir to function as a piercing element for breaking seals. Both pieces are preferably comprised of an opaque material which blocks all light from spoiling the beverage additives. When the two pieces are fitted together, the multiple seals prevent spoilage of the beverage additives due to heat, humidity, air, and other environmental factors. The seals further prevent the fluid in the bottle from prematurely mixing with the beverage additives. Both pieces are preferably fabricated from a material such as plastic through an injection mold or similar process. One skilled in the art, however, will recognized that other materials, including but not limited to polymer resin, paper, glass, rubber, silica, carbon, metal, or a combination of these materials (including plastic), may be utilized to achieve the benefits of the writing.

A first embodiment of the bottom piece 5 is depicted in FIG. 1. The bottom piece 5 as represented in FIG. 1A represents a cutaway view of the bottom piece 5, and FIG. 1B depicts the exterior view of the bottom piece 5. Bottom piece 5 is comprised of a hollow compartment 10, formed by interior wall 58, which has an opening 15 at the top to receive the top piece 70, and comprises a plurality of rings 30 of a preferably triangular form which prevent beverage additives 170 and bottle fluid 180 from traveling up through the gap 65 between the top piece 70 and bottom piece 5 when fitted together. The rings 30 are towards the bottom of compartment along bottom piece interior wall 58, and are spaced in a manner as to maximize control, minimize additional raw materials for manufacture, maximize sealing of the cap 1, and minimize the effort required to move the piercing mechanism 75 which is in contact with the rings 30. Bottom piece 5 also includes a recess 56, an annular space 57 and a protrusion 59.

At the bottom 20 of compartment 10 is a seal 25 which prevents premature exposure of the beverage additives 170, and ensures that the beverage additive 170 and the fluid 180 in the bottle 160 are not tampered with or otherwise contaminated. Said bottom seal 25 is similar to those well known in the art and used on plastic spouts of half gallon cartons containing milk and juice. The seal 25 is of a particular thickness necessary to prevent accidental discharge of the beverage additives, considering changes in temperature, pressure, humidity, and other environmental fluctuations to be encountered. Said bottom seal 25 is of a lesser thickness around the periphery, creating line of weakness 28, which enables seal 25 to remain sealed until pushed upon by another component of the bottle cap 1. The force necessary to break the seal 25, and thus combine the beverage additives 170 with the bottled fluid 180, can vary depending upon the intended use of the beverage additives 170 and the bottled fluid 180 (e.g. stronger seal for travel, lighter seal for children or the elderly). Furthermore, the force necessary to break the seal 25 can be varied depending upon the type of piercing mechanism 75 embodied in the present writing (e.g., screw mechanism or plunger mechanism).

Bottom piece 5 further comprises exterior wall 48, which with rings or threads 35, enables bottle cap 1 to screw onto bottle 160. Such screw cap mechanisms as rings or threads 35 are well known in the art. At or near the base of exterior wall 48, line of weakness 45 separates exterior wall 48 from screw cap seal 40. When bottle cap 1 is twisted for removal from bottle 160, line of weakness 45 breaks, separating screw cap seal 40 from bottle cap 1 along line of weakness 45. Line of weakness 45 is of a particular strength to ensure that insignificant twisting can occur due to handling, bottling, transport, etc. without breaking line of weakness 45—however bottle cap 1 cannot be removed without breaking line of weakness 45. Line of weakness 45 and screw cap seal 40 further ensure that the beverage additives 170 and fluid 180 are fresh, and have not been prematurely released, exposed, contaminated or otherwise adulterated.

At or near compartment opening 15 of bottom piece 5 is located barrier surface 60 which stops the downward motion of top piece 70 when depressed to release beverage additives 170 into bottle 160. Adjacent to barrier surface 60 is notched groove 50. Notched groove 50 is a recessed area which is of sufficient size to receive ring 90 to lock top piece 70 into bottom piece 5. Notched groove 50 and ring 90 can preferably be generally triangular in shape; however squared, rounded, or otherwise shaped grooves and rings are anticipated by the inventor.

At the top of bottom piece 5 is lock seal 55. Lock seal 55 prevents top piece 70 from being prematurely depressed into bottom piece 5. When lock seal 55 is removed (such as a via a break away pull tab handle as illustrated in FIG. 1), top piece 70 is free to be pressed downwards into bottom piece 5. As shown in FIG. 1D, lock seal 55 is of a precise height. When lock seal 55 is removed, this height is removed, top part 70 is then free to travel downward the distance represented by the now removed lock seal 55. This distance (along with the angle of inclination of angled circular edge 100) is exactly or reasonably approximate the distance necessary for top piece 70 to come to rest on barrier surface 60, with ring 90 locking into notched groove 50. This distance is further exactly or reasonably approximately sufficient to allow piercing mechanism 75 to partially (but not wholly) break open bottom seal 25 at line of weakness 28. This distance represented by the height of lock seal 55 allows piercing mechanism 75 to break open bottom seal 25, but not fully sever or break through all of line of weakness 28. With part of line of weakness 28 remaining unbroken, bottom seal 25 is partially attached to bottom piece 5, and thus moves sufficiently to allow all of the beverage additives 170 to be released into bottle 160 without bottom seal 25 falling into bottle 160, causing a choking or other safety hazard.

A first embodiment of top piece 70 of bottle cap 1 is disclosed in FIG. 1. Top piece 70 as represented in FIG. 1A represents a cutaway view of the top piece 70, and FIG. 1B depicts the exterior view of the top piece 70. Top piece 70 comprises a hollow piercing mechanism 75, which is formed by exterior wall 80, and has an angled circular edge 100 at the bottom of piercing mechanism 75. Angled circular edge 100 is at an angle of inclination necessary, when lock seal 55 is removed and top piece 70 is pushed into bottom piece 5, that angled circular edge 100 breaks through most, but not all, of line of weakness 28 to open bottom seal 25. This allows bottom seal 25 to be partially attached at line of weakness 28 to bottom piece 5 so that bottom seal 25 does not fall into fluid 180 in bottle 160, creating a choking or other safety hazard. Top piece 70 also includes recess(es) 81 and protrusion(s) 82.

Top piece 70 further comprises barrier surface 85, which when top piece 70 is depressed, comes to rest on barrier surface 60. This is one component which stops top piece 70 from being pushed too far into bottom piece 5, thus causing bottom seal 25 to fall into bottle 160. Near or adjacent to barrier surface 85 is ring 90 which locks into notched groove 50 as disclosed above. Top piece 70 further comprises cap top 95, which is of sufficient thickness and strength to prevent tampering or other adulteration of beverage additives 170.

FIG. 1C shows an exterior view of top piece 70, which has been filled with beverage additive 170 (not shown), and coupled with bottom piece 5. Lock seal 55 prevents premature depression of top piece 70 into bottom piece 5. Cap top 95 may include grooves (or other textured surface) as depicted in FIG. 1C to facilitate handling by an individual.

FIG. 1D shows a cutaway view of bottle cap 1, where top piece 70 has been filled with beverage additive 170, and coupled with bottom piece 5. This cutaway view further demonstrates that lock seal 55 is of such a size to govern the distance needed to be traveled by top piece 70 when depressed into bottom piece 5. FIG. 1D further illustrates gap 65 which is between top piece 70 and bottom piece 5 when coupled. This allows the unencumbered movement of top piece 70 when pressed downward into bottom piece 5. FIG. 1D further shows rings 30, which are of a generally triangular profile, which serve to prevent fluid in bottle 160 from moving up through gap 65 when bottom seal 25 is broken. This will prevent fluid from leaking out of the cap once top piece 70 has been depressed into bottom piece 5, and further prevents leakage when bottle 160 is preferably shaken to mix beverage additives 170 with fluid 180. Rings 30 further keep beverage additives 170 sealed and protected from exposure.

FIG. 1E shows entire bottle cap 1, comprising bottom piece 5, top piece 70, and beverage additive 170, which has been screwed on to bottle 160. Beverage additive 170 is sealed within bottle cap 1, and bottle cap 1 is placed on bottle 160 immediately after filling, sterilization, and/or pasteurization of fluid 180 in bottle 160. Placement of bottle cap 1 on bottle 160 during production ensures that the contents of bottle cap 1 and bottle 160 are as clean and sterile as possible. FIG. 1E demonstrates bottle cap 1 prior to the removal of lock seal 55.

FIG. 1F shows bottle cap 1 after lock seal 55 is removed, and top piece 70 is pushed down into bottom piece 5, which causes angled circular edge 100 to push into bottom seal 25, which partially detaches along line of weakness 28, causing beverage additive 170 (stored in compartment 10 and the hollow center of piercing mechanism 75) to empty into bottle 160 and mix with fluid 180 (not featured).

Figure 2:
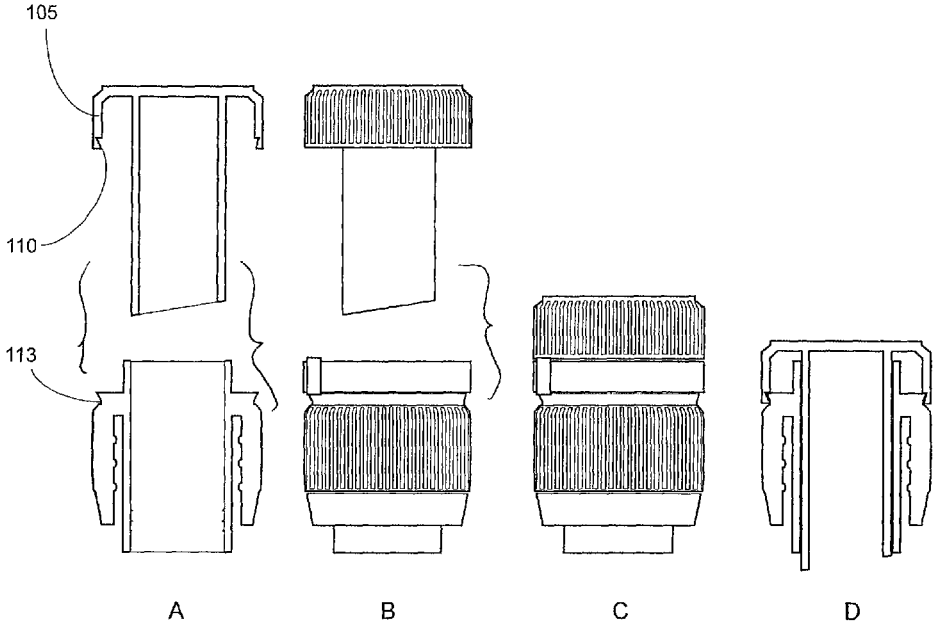
FIG. 2A is an exploded cutaway view of a second embodiment of the cap of the present writing, depicting the two pieces of the cap.
FIG. 2B is an exploded outside perspective of a second embodiment of the cap of the present writing, depicting the two pieces of the cap.
FIG. 2C is an outside perspective of a second embodiment of the cap of the present writing, depicting the two pieces of the cap coupled together prior to engaging the mechanism to release the beverage additives into the fluid.
FIG. 2D is a cutaway closed perspective of a second embodiment of the cap of the present writing, depicting the two pieces of the cap coupled together prior to engaging the mechanism to release the beverage additives into the fluid.

FIG. 2 demonstrates a second alternative embodiment of bottle cap 1. As is clear by comparing FIGS. 1 and 2, almost all parts of bottle cap 1 are the same in each embodiment, except for the components identified in FIG. 2. As depicted in the cutaway view of FIG. 2A, exterior surface 105 of cap top 95 of top piece 70 is of a different form than in the first embodiment. This allows for the formation of notch 110, which fits interlockingly with groove 113 of bottom piece 5. When top piece 70 is depressed or pushed down into bottom piece 5, the lateral movement of top cap 70 is stopped by the locking of notch 110 with groove 113. This alternative method of locking allows for a different bottle cap 1 design which may utilize less raw materials for production, and which may be easier to engage for different individuals. This alternative embodiment further reduces the weight of bottle cap 1, thereby reducing shipping costs. The alternative embodiment further provides a larger grooved gripping surface for exterior surface 105, which may be easier for use by weaker individuals such as children or the elderly. FIG. 2B shows the same components as FIG. 2A from an exterior view. FIG. 2C shows an exterior view of top piece 70 coupled with bottom piece 5 prior to removal of lock seal 55. FIG. 2D shows a cutaway view of bottle cap 1, where lock seal 55 has been removed, top piece 70 has been pushed into bottom piece 5, and notch 110 has engaged with groove 113, locking top piece 70 with bottom piece 5. Partially attached bottom seal 25 is not shown.

Figure 3:
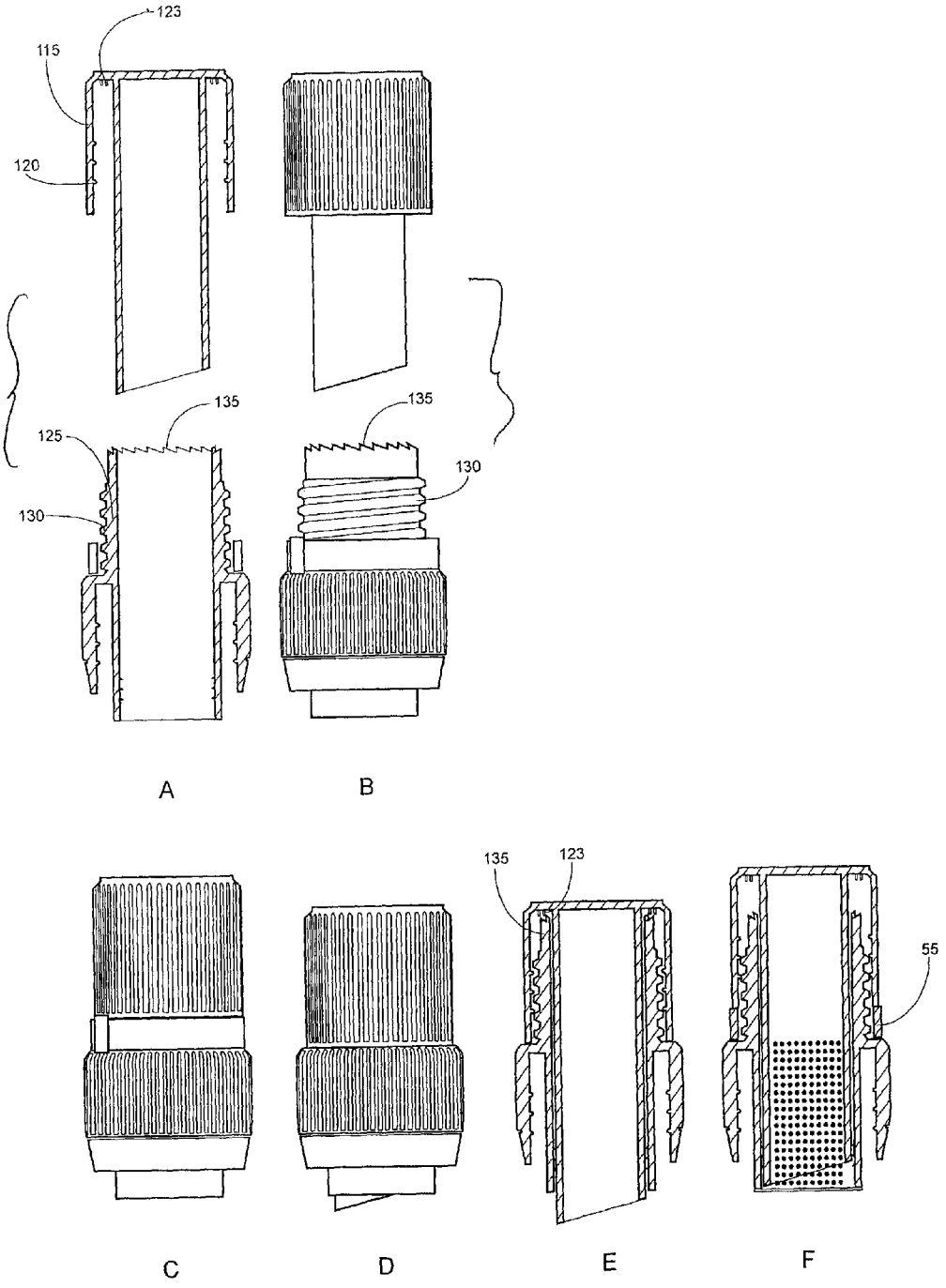
FIG. 3A is an exploded cutaway view of a third embodiment of the cap of the present writing, depicting the two pieces of the cap.
FIG. 3B is an exploded outside perspective of a third embodiment of the cap of the present writing, depicting the two pieces of the cap.
FIG. 3C is an outside perspective of a third embodiment of the cap of the present writing, depicting the two pieces of the cap coupled together prior to engaging the mechanism to release the beverage additives into the fluid.
FIG. 3D is an outside perspective of a third embodiment of the cap of the present writing, depicting the two pieces after engaging the mechanism to release the beverage additives into a fluid.
FIG. 3E is a cutaway perspective of a third embodiment of the cap of the present writing, depicting the two pieces after engaging the mechanism to release the beverage additives into a fluid.
FIG. 3F is a cutaway perspective of a third embodiment of the cap of the present writing, depicting the two pieces of the cap coupled together prior to engaging the mechanism to release the beverage additives into a fluid.

FIG. 3 demonstrates a third alternative embodiment of bottle cap 1. As is clear by comparing FIGS. 1 and 3, almost all parts of bottle cap 1 are the same in each embodiment, except for the components identified in FIG. 3. This alternative embodiment of bottle cap 1 discloses a screw method for moving top piece 70 into bottom piece 5 and breaking bottom seal 25. This further protects against accidental engagement of top piece 70, preventing premature discharge of beverage additive 170 into bottle 160. This alternative embodiment further facilitates use by individuals for which it may be difficult to press down top piece 70 into bottom piece 5 with sufficient force to partially detach bottom seal 25 at line of weakness 28, as demonstrated by the other embodiments of bottle cap 1. As depicted in the cutaway view of FIG. 3A, the screw mechanism is achieved with an alternative cap exterior surface 115 of top piece 70, which comprises concentric rings 120, and twist lock 123. Bottom piece 5 has extended top wall 125, which makes bottom piece 5 larger than the other embodiments of the writing. This extended top wall 125 comprises concentric ring 130, which starts at or near the base of top wall 125, and forms the guide ring of the screw mechanism. As depicted in FIG. 3B, concentric ring 130 wraps around the exterior edge of extended top wall 125 in an angled manner. Not shown is the reverse of FIG. 3B, which would fully demonstrate that concentric ring 130 forms one continuous unitary ring. Extended top wall 125 further comprises a plurality of twist lock teeth 135. Twist lock teeth 135 are preferably formed so that one side is slightly angled, and the other side is at or near perpendicular across an axis. The twist lock teeth may be all the same height, or may be of different height to achieve the desired results, and further may have differing angles to accomplish the same results. The desired goal of twist lock 123 and twist lock teeth 135 is that twist lock teeth 135 are angled to allow twist lock 123 to pass over the angled surface of twist lock teeth 135 in one direction, but prevent the twist lock teeth 135 from moving in the opposite direction. Twist lock teeth 135 may be angled in such a manner as to facilitate clockwise or counterclockwise rotation of top piece 70, depending upon the needs of the product, the manufacturer, the producer, the target market, etc. Once lock seal 55 is removed, top piece 70 is twisted, and twist lock 123 passes over some twist lock teeth 135, top piece 70 cannot be twisted to its original position. This further ensures that the bottle cap mechanism 1 is engaged only once, and prevents tampering with the beverage additives or fluid contained in the bottle. The individual continues to twist top piece 70, using the grooved or otherwise textured surface of top piece exterior surface 115 to facilitate gripping and twisting of the bottle cap.

FIG. 3B shows an exterior perspective of the pieces as depicted in FIG. 3A. FIG. 3C shows bottle cap 1, with beverage additives 170 (not shown) stored in top piece 70 and bottom piece 5, prior to the removal of lock seal 55. FIG. 3D shows bottle cap 1 with lock seal 55 removed, and after an individual has twisted top piece 70 in a manner sufficient to push top piece 70 down, causing piercing mechanism 75 to partially detach bottom seal 25 at line of weakness 28 and release beverage additive 170 into bottle 160. FIG. 3E shows a cutaway view of FIG. 3D, and FIG. 3F shows a cutaway view of FIG. 3C. Bottom seal 25 is not shown in FIG. 3D, 3E, or 3F.

Figure 4:
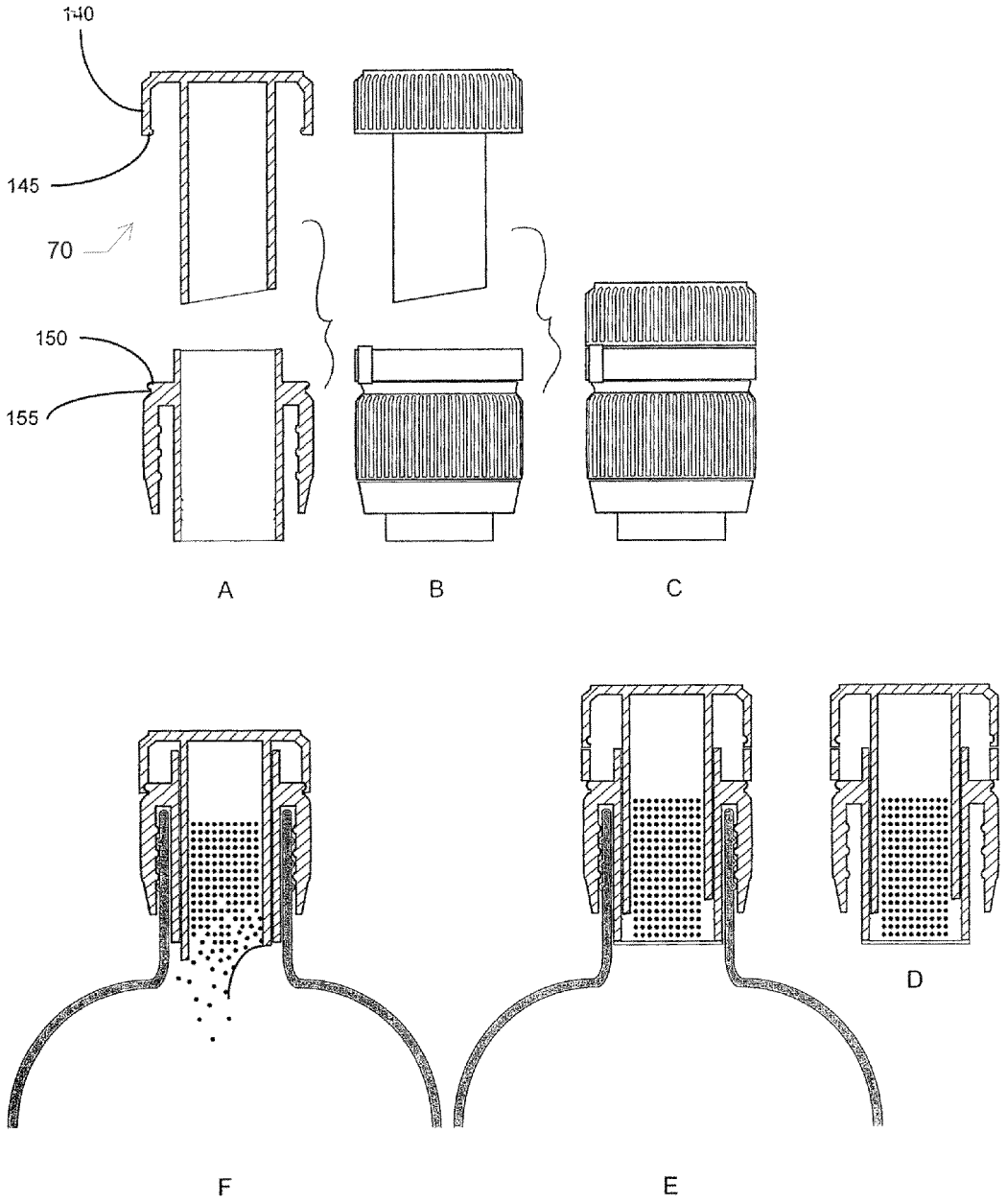
FIG. 4A is an exploded cutaway view of a fourth embodiment of the cap of the present writing, depicting the two pieces of the cap.
FIG. 4B is an exploded outside perspective of a fourth embodiment of the cap of the present writing, depicting the two pieces of the cap.
FIG. 4C is an outside perspective of a fourth embodiment of the cap of the present writing, depicting the two pieces of the cap coupled together prior to engaging the mechanism to release the beverage additives into the fluid.
FIG. 4D is a cutaway closed perspective of a fourth embodiment of the cap of the present writing, depicting the two pieces of the cap coupled together and filled with beverage additives prior to engaging the mechanism to release the beverage additives into a fluid.
FIG. 4E is a cutaway view of a fourth embodiment of the cap of the present writing, depicting the two pieces of the cap coupled together, filled with beverage additives, and placed atop a bottle prior to engaging the mechanism to release the beverage additives into a fluid.
FIG. 4F is a cutaway view of a fourth embodiment of the cap of the present writing, depicting the two pieces of the cap coupled together, filled with beverage additives, placed atop a bottle, and engaged to break all seals and release the beverage additives into the bottle.

FIG. 4 demonstrates a fourth alternative embodiment of bottle cap 1. As is clear by comparing FIGS. 1 and 4, almost all parts of bottle cap 1 are the same in each embodiment, except for the components identified in FIG. 4. As depicted in the cutaway view of FIG. 4A, exterior surface 140 of cap top 95 of top piece 70 is of a different form than in the first embodiment. This allows for the formation of ring 145, which fits interlockingly with ring 150 and recessed groove 155 of bottom piece 5. When top piece 70 is depressed or pushed down into bottom piece 5, the lateral movement of top piece 70 is stopped by the locking of ring 145 with ring 150 and groove 155. This alternative method of locking allows for a different bottle cap 1 design which may utilize less raw materials for production, and which may be easier to engage for different individuals. This alternative embodiment further reduces the weight of bottle cap 1, thereby reducing shipping costs. The alternative embodiment further provides a larger grooved (or otherwise textured) gripping surface for exterior surface 140, which may be easier for use by weaker individuals such as children or the elderly. FIG. 4B shows the same components as FIG. 4A from an exterior view. FIG. 4C shows an exterior view of top piece 70 coupled with bottom piece 5 prior to removal of lock seal 55. FIG. 4D shows a cutaway view of the exterior view in FIG. 4C.

FIG. 4E shows entire bottle cap 1, comprising bottom piece 5, top piece 70, and beverage additive 170, which has been screwed on to bottle 160. Beverage additive 160 is sealed within bottle cap 1, and bottle cap 1 is placed on bottle 160 immediately after filling, sterilization, and/or pasteurization of fluid 180 in bottle 160. Placement of bottle cap 1 on bottle 160 during production ensures that the contents of bottle cap 1 and bottle 160 are as clean and sterile as possible. FIG. 4E demonstrates bottle cap 1 prior to the removal of lock seal 55.

FIG. 4F shows bottle cap 1 after lock seal 55 is removed, and top piece 70 is pushed down into bottom piece 5, which causes angled circular edge 100 to push into bottom seal 25, which partially detaches along line of weakness 28, causing beverage additive 170 (stored in compartment 10 and the hollow center of piercing mechanism 75) to empty into bottle 160 and mix with fluid 180 (not featured). FIG. 4F further demonstrates how ring 145 has engaged with ring 150 and recessed groove 155, locking top piece 70 with bottom piece 5.

These aspects of the writing, as well as others described herein, can be achieved by using the methods, articles of manufacture and compositions of matter described herein. To gain a full appreciation of the scope of the present writing, it will be further recognized that various aspects of the present writing can be combined to make desirable embodiments of the writing.

EXAMPLE

The following are non-limiting examples of the present writing. A bottled water producer desires to add beverage additives, including flavoring, fruit concentrates, sweeteners, vitamins, minerals, and herbal supplements to water. The producer does not desire to mix the beverage additives with the water when the bottled water is produced, because the flavors of the beverage additives, when combined with water, may change taste during prolonged exposure to a plastic bottle. Furthermore, the water and flavored drink mix (including any sweetening agents) may degrade the vitamins and herbal supplements (and in some cases such as vitamin C, rapidly degrade). The bottled water producer would thus be required to add additional vitamins and herbal supplements to the beverage when produced, increasing costs. After a determined period of time (the expiration date) less than the labeled amounts of vitamins and herbal supplements will be present in the beverage, thus shortening the shelf life of the beverage.

Using the cap of the present writing, the bottled water producer can store the beverage additives in the reservoir of the bottle cap. The components are kept dry and sealed, away from heat, light, air, humidity, and other environmental concerns which might degrade the quality and strength of the components of the beverage additives. Beverage additives retain their quality and strength for a significantly longer period of time when maintained in a dry, cool, sealed, low humidity, and dark environment such as the one created by the present writing.

Further with the present writing, the bottled water producer can sterilize, filter, and pasteurize the water in the bottle. Doing so when the beverage additives are present can degrade the strength, quality, and efficacy of the drink mix, vitamins, and herbal supplements and other beverage additives. The present writing allows the bottled water producer to maximize the safety of the water separately from maximizing the safety of the dry components.

Using an assembly line system or similar machinary in a sterile (or otherwise protected and safe) environment, the top piece of the cap of the writing is filled with a predetermined amount of a plurality of beverage additives which are to be added to water. Once the beverage additives are added to the top piece, the bottom piece is joined with the top piece. All seals remain in place, protecting the beverage additives, and ensuring that the beverage additives are not prematurely released into the environment or the bottle.

Concurrently water is placed into a sterile bottle through an assembly line or similar processing machine. The water is filtered, heated, and otherwise cleaned to the highest of purity standards.

The entire cap is then screwed on the water bottle. This is done in a manner as to ensure a tight (and thus safe) seal, but not too strong as to break any of the safety seals. The water bottle with attached cap is then checked for safety and other factors, and then packaged for shipping.

Upon purchase of the bottle with attached cap, the consumer can quickly determine that all of the safety seals are still intact. If intact, the consumer removes the lock seal, and depresses the top piece of the cap into the bottom piece of the cap through either pushing, or in an alternative embodiment, by screwing. As the top piece of the cap moves down, the piercing mechanism partially breaks the bottom seal along its line of weakness. This allows the dried beverage additives to empty down into the water in the bottle below. The bottom safety seal remains attached at some part of the line of weakness as to prevent a choking or other safety hazard. The consumer stops moving the top piece when it clicks or locks into place with the bottom piece. The consumer shakes or otherwise agitates the contents of the bottle to mix the beverage additives with the water. When done mixing the contents, the consumer unscrews the entire bottle cap (which is now the top piece and the bottle piece locked together), and enjoys the mixed beverage.

In a further example of the cap of the present writing, the bottle cap reservoir is divided into separate chambers which can store and keep separate dried beverage additives. The bottle cap can further be used to store liquid beverage additives, as well as both liquid and dry beverage additives concurrently.

In a further example of the cap of the present writing, the beverage is a juice or a tea.

In a further example of the cap of the present writing, the entire bottle cap is removed prior to depressing the top piece, and the contents of the bottle are heated on a stove, microwave, or other heating device. The bottle cap is then reattached, the top piece is pushed down into the bottom piece, and the beverage additives are added to warm or hot water as needed for the intended beverage.

In a further example of the cap of the present writing, the cap is comprised of a material to protect as much as possible the contents stored therein from oxidation, moisture light, air, heat and other elements which might degrade the quality and strength of the materials stored therein.

In broad summary, some of the elements here disclosed are as follows.

As a first concept, this writing teaches a safety sealed reservoir bottle cap.

As a second concept, this writing teaches a cap comprised of a first part, a second part, and a removable seal, the second part containing a reservoir therein, the first part being connected to the second part by the removable seal.

As a third concept, this writing teaches a cap comprised of a first part; a second part, the second part containing a reservoir therein; a removable seal, the first part being connected to the second part by the removable seal, the first part and the second part each defining a hollow area and each being closed at one end, the first part being slidable within the hollow of the second part such that the reservoir lies within the hollow of the first part and the second part, the first part having an edge opposite its closed end that can sever a portion of the closed end of the second part.

As a fourth concept, this writing teaches a cap of any of the preceding concepts wherein the cap when joined to a container opening will seal that container opening.

As a fifth concept, this writing teaches a cap of any one of the preceding concepts comprised of a material to protect from degradation the contents therein.

As a sixth concept, this writing teaches a cap as set forth in any of the preceding concepts wherein upon removal of said removable seal, said first part may be pressed against said second part and sever a portion of the closed end of the second part thereby enabling access to said reservoir through the closed end of the second part.

As a seventh concept, this writing teaches the cap of any of the preceding concepts wherein the second part contains engagement means for engaging with a container which the cap will cap.

As an eighth concept, this writing teaches the cap of any of the preceding concepts wherein the first part and the second part contain locking means such that when the safety seal is removed and the first part is pushed against the second part, the locking means of the first part and the second part will engage.

As a ninth concept, this writing teaches a cap comprised of two parts and three seals.

As a tenth concept, this writing teaches a cap comprised of two parts and three seals, the two parts being a bottom part and a top part that is connectable in a sealed fashion to the bottom part; the three seals being a first removable seal that connects the first part and the second part to each other, a second seal which comprises a wall of the bottom part and which may be severed in part from said bottom part by said top part, and engagement means associated with said first part and said second part such that upon removal of said first seal, said first part and said second part may be joined through said engagement means to sealingly hold said first part to said second part.

As an eleventh concept, this writing contemplates that the cap may be comprised of one piece.

As a twelfth concept, this writing contemplates that the cap may be comprised of more than two pieces.

As a thirteenth concept, this writing teaches a cap comprised of two parts and three seals, the two parts being a bottom part and a top part that is connectable in a sealed fashion to the bottom part; the three seals being a first breakable seal that connects the first part and the second part to each other, a second seal which comprises a wall of the bottom part and which may be severed in part from said bottom part by said top part, and engagement means associated with said first part and said second part such that upon breaking said first seal, said first part and said second part may be joined through said engagement means to sealingly hold said first part to said second part.

As a fourteenth concept, a sealed reservoir cap comprising: a first hollow part capped at one end thereof and formed with a first protrusion on its outer diameter and a first recess; a second hollow part having a punchable seal closing one end thereof and slidably receiving the first hollow part therein with the punchable seal axially opposite from the capped end to define an enclosed reservoir therebetween; the second hollow part further formed with a second protrusion around its inner diameter and a second recess to receive the first protrusion therein, the two hollow parts defining a first annular space therebetween sealed by engagement of the second protrusion against the first recess on the outer diameter of the first hollow part, and an annular part disposed around and securely attached to the outside of the second hollow part to define a second annular space therebetween, the annular part formed with threads extending around its inner diameter to threadably engage a bottleneck in the second annular space and dispose the punchable seal within the bottle.

As a fifteenth concept, a cap of any of the preceding concepts wherein the punchable seal has a scored line of weakness such that the uncapped end dislodges a portion of the punchable seal.

As a sixteenth concept, a cap of any of the preceding concepts wherein the uncapped edge is defined by an oval.

As a seventeenth concept, a cap of any of the preceding concepts wherein the cap is fabricated from materials selected to prevent degradation of contents within the enclosed reservoir.

As an eighteenth concept, a cap of any of the preceding concepts wherein the enclosed reservoir contains dry or liquid contents.

As a nineteenth concept, a cap of any of the preceding concepts wherein the contents of the enclosed reservoir are released upon dislodging the punchable seal.

As a twentieth concept, the cap of any of the preceding concepts wherein the first and second hollow parts and the annular part are one continuous piece of material.

As a twenty-first concept, the cap of any of the preceding concepts wherein the first and second hollow parts and the annular part are more than one piece of material.

As a twenty-second concept, the cap of any of the preceding concepts wherein more than one enclosed reservoir lies within the first and second hollow parts.

As a twenty-third concept, a sealed reservoir cap comprising a first hollow part capped at one end thereof; a second hollow part having a punchable seal closing one end thereof and slidably receiving the first hollow part therein with the punchable seal axially opposite from the capped end to define an enclosed reservoir therebetween; a removable annular seal holding the two hollow parts in an axially fixed, spaced apart relationship and, upon removal of the removable annular seal, allowing the first hollow part to be pushed into the second hollow part allowing for engagement of a locking means and the uncapped end of the first hollow part to dislodge the punchable seal, and an annular part disposed around and securely attached to the outside of the second hollow part to define a first annular space therebetween, the annular part formed with threads extending around its inner diameter to threadably engage a bottleneck in the second annular space and dispose the punchable seal within the bottle.

As a twenty-fourth concept, the cap of any of the preceding concepts, wherein the first hollow part further comprises a first protrusion on its outer diameter and the second hollow part further comprises a second recess to receive the first protrusion wherein when the first hollow part is pushed into the second hollow part, the first protrusion is engaged to the second recess thereby forming the locking means.

As a twenty-fifth concept, the cap of any of the preceding concepts wherein the first hollow part is formed with a first recess around its outer diameter and second hollow part is formed with a second protrusion around its inner diameter and the two hollow parts define a second annular space therebetween sealed by engagement of the second protrusion into the first recess.

As a twenty-sixth concept, a sealed reservoir cap comprising: a first hollow part capped at one end thereof and formed with a first recess around its outer diameter; a second hollow part having a punchable seal closing one end thereof and slidably receiving the first hollow part therein with the punchable seal axially opposite from the capped end to define an enclosed reservoir therebetween; the second hollow part further formed with a second protrusion around its inner diameter, the two hollow parts defining a first annular space therebetween sealed by engagement of the second protrusion against the first recess on the outer diameter of the first hollow part; a removable annular seal holding the two hollow parts in an axially fixed, spaced apart relationship and, upon removal of the removable annular seal, allowing the first hollow part to be pushed into the second hollow part for the uncapped end of the first hollow part to dislodge the punchable seal, and an annular part disposed around and securely attached to the outside of the second hollow part to define a second annular space therebetween, the annular part formed with threads extending around its inner diameter to threadably engage a bottleneck in the second annular space and dispose the punchable seal within the bottle.

As a twenty-seventh concept, the cap of any of the preceding concepts wherein the first hollow part further comprises a first protrusion on its outer diameter and the second hollow part further comprises a second recess to receive the first protrusion wherein when the first hollow part is pushed into the second hollow part, the first protrusion is engaged to the second recess thereby forming a locking means.

As a twenty-eighth concept, a method for forming a sealed reservoir cap comprising the steps of: forming a first hollow part capped at one end thereof with a first protrusion and a first recess on its outer diameter; forming a second hollow part having a punchable seal closing one end thereof and capable of slidably receiving the first hollow part therein with the punchable seal axially opposite from the capped end to define an enclosed reservoir therebetween; forming a second protrusion around the inner diameter of the second hollow part; forming a second recess to receive the first protrusion therein; forming a first annular space between the two hollow parts; sealing said first annular space by engagement of the second protrusion with the first recess; forming a removable annular seal disposed to hold the two hollow parts in an axially fixed spaced apart relationship; allowing the first hollow part to be pushed into the second hollow part for the first protrusion to be received in the second recess and the uncapped end of the first annular part to dislodge the punchable seal by removing the removable seal; forming an annular part disposed around and securely attached to the outside of the second hollow part to define a second annular space therebetween; forming threads extending around the inner diameter of the third annular part to engage a bottleneck in the second annular space and dispose the punchable within the bottle.

As a twenty-ninth concept, a method for forming a sealed reservoir cap of any of the preceding concepts further comprising the step of scoring a line of weakness such that the uncapped end dislodges only a portion of the punchable seal.

As a thirtieth concept, a method for forming a sealed reservoir cap of any of the preceding concepts comprising the step of forming the uncapped end in an oval shape.

As a thirty-first concept, a method for forming a sealed reservoir cap of any of the preceding concepts further comprising the step of forming the sealed reservoir cap from materials selected to prevent degradation of contents within the enclosed reservoir.

As a thirty-second concept, a method for forming a sealed reservoir cap of any of the preceding concepts wherein the first and second hollow parts and the annular part are one piece of material.

As a thirty-third concept, a method for forming a sealed reservoir cap of any of the preceding concepts wherein the first and second hollow parts and the annular part are more than one piece of material.

As a thirty-fourth concept, the method for forming a sealed reservoir cap of any of the preceding concepts further comprising the step of forming more than one enclosed reservoir defined by the first and second hollow parts.

As a thirty-fifth concept, the method for forming a sealed reservoir cap of any of the preceding concepts further comprising the step of one selected from the group of sterilizing, filtering, pasteurizing and combinations thereof the contents of the bottle container prior to providing the sealed reservoir cap to the bottle.

As a thirty-sixth concept, the method for forming a sealed reservoir cap of any of the preceding concepts further comprising the step of mixing the released reservoir contents with the contents of the bottle.

As a thirty-seventh concept, the method for forming a sealed reservoir cap of any of the preceding concepts further comprising the step of removing the sealed reservoir cap from the bottle and heating the contents of the bottle container prior to removal of the removable seal.

As a thirty-eighth concept, the cap of the fourteenth concept further comprising a removable annular seal holding the two hollow parts in an axially fixed, spaced apart relationship and, upon removal of the removable annular seal, allowing the first hollow part to be pushed into the second hollow part for the first protrusion to be received in the second recess and the uncapped end of the first hollow part to dislodge the punchable seal.

The invention claimed is:

1. A sealed reservoir cap comprising:

a first hollow part capped at one end thereof and formed with a protrusion on an outer diameter of the first hollow part, wherein said protrusion comprises a ring;

a second hollow part having a punchable seal closing one end thereof and slidably receiving the first hollow part therein with the punchable seal axially opposite from the capped end to define an enclosed reservoir therebetween;

the second hollow part comprising:

a recess to receive the protrusion therein, the two hollow parts defining a first annular space therebetween sealed by engagement of the protrusion against the recess;

a notched groove positioned on a wall of the recess and arranged in said inner diameter to receive said ring when the first hollow part is pressed into the second hollow part through the punchable seal; and an annular part disposed around and securely attached to the outside of the second hollow part to define a second annular space between the annular part and the second hollow part, the annular part formed with threads extending around an inner diameter of the annular part to threadably engage a bottleneck in the second annular space and dispose the punchable seal within the bottle; and a removable annular seal holding the two hollow parts in an axially fixed, spaced apart relationship and, upon removal of the removable annular seal, allowing the first hollow part to be pushed into the second hollow part for the first protrusion to be received in the second recess and the uncapped end of the first hollow part to dislodge the punchable seal.

2. The sealed reservoir cap of claim 1, wherein the punchable seal has a scored line of weakness such that the uncapped end dislodges a portion of the punchable seal.

3. The sealed reservoir cap of claim 1, wherein the uncapped edge is defined by an oval.

4. The sealed reservoir cap of claim 1 fabricated from materials selected to prevent degradation of contents within the enclosed reservoir.

5. The sealed reservoir cap of claim 1, wherein the enclosed reservoir contains dry or liquid contents.

6. The sealed reservoir cap of claim 5, wherein the contents of the enclosed reservoir are released upon dislodging the punchable seal.

7. The sealed reservoir cap of claim 5, wherein the contents of the enclosed reservoir are released upon dislodging the punchable seal.

8. A sealed reservoir cap comprising:

a first hollow part capped at one end thereof;

a second hollow part having a punchable seal closing one end thereof and slidably receiving the first hollow part therein with the punchable seal axially opposite from the capped end to define an enclosed reservoir therebetween;

a removable annular seal holding the two hollow parts in an axially fixed, spaced apart relationship and, upon removal of the removable annular seal, allowing the first hollow part to be pushed into the second hollow part allowing for engagement of a locking means and an uncapped end of the first hollow part to dislodge the punchable seal, and an annular part disposed around the outside of the second hollow part to define a first annular space between the annular part and the outside of the second hollow part, the annular part formed with threads extending around an inner diameter of the annular part to threadably engage a bottleneck in the first annular space and dispose the punchable seal within the bottle;

a ring portion attached to the annular part, said ring portion having a groove; and a notch set on an exterior portion of the first hollow part and positioned such that it interfaces with the groove of the ring portion when the first hollow part is pressed into the second hollow part through the punchable seal.

9. The sealed reservoir cap of claim 8, further comprising an annular seal wherein the first hollow part is formed with a recess around an outer diameter of the first hollow part and the second hollow part is formed with a protrusion around an inner diameter of the second hollow part and the two hollow parts define a second annular space therebetween sealed by engagement of the protrusion of the second hollow part into the recess of the first hollow part.

10. The sealed reservoir cap of claim 8, wherein the punchable seal has a scored line of weakness such that the uncapped end dislodges a portion of the punchable seal.

11. The sealed reservoir cap of claim 8, wherein the uncapped edge is defined by an oval.

12. The sealed reservoir cap of claim 8 fabricated from materials selected to prevent degradation of contents within the enclosed reservoir.

13. The sealed reservoir cap of claim 8, wherein the enclosed reservoir contains dry or liquid contents.

14. A sealed reservoir cap comprising:

a first hollow part capped at one end thereof and comprising a protrusion and a recess around an outer diameter of the first hollow part, wherein said first protrusion comprises a ring;

a second hollow part having a punchable seal closing one end thereof and slidably receiving the first hollow part therein with the punchable seal axially opposite from the capped end to define an enclosed reservoir therebetween;

the second hollow part further formed with a barrier surface around an inner diameter of the second hollow part and a notched groove arranged in the inner diameter of the second hollow part to receive said ring when the first hollow part is pushed into the second hollow part through the punchable seal, the two hollow parts defining a first annular space therebetween sealed by engagement of the barrier surface against a surface forming the recess on the outer diameter of the first hollow part;

a removable annular seal holding the two hollow parts in an axially fixed, spaced apart relationship and, upon removal of the removable annular seal, allowing the first hollow part to be pushed into the second hollow part for the uncapped end of the first hollow part to dislodge the punchable seal, and an annular part disposed around and securely attached to the outside of the second hollow part to define a second annular space between the annular part and the outside of the second hollow part, the annular part formed with threads extending around its inner diameter to threadably engage a bottleneck in the second annular space and dispose the punchable seal within the bottle.

15. A method for forming a sealed reservoir cap comprising the steps of:

forming a first hollow part capped at one end thereof with a first protrusion, wherein said first protrusion comprises a ring;

forming a second hollow part having a punchable seal closing one end thereof and capable of slidably receiving the first hollow part therein with the punchable seal axially opposite from the capped end to define an enclosed reservoir therebetween;

forming a barrier surface around the inner diameter of the second hollow part;

forming a notched groove arranged in said inner diameter to, when the first hollow part is pushed into the second hollow part through the punchable seal, receive said ring;

forming a recess to receive the protrusion therein;

forming a first annular space between the two hollow parts;

sealing said first annular space by engagement of the barrier surface with the first hollow part;

forming a removable annular seal disposed to hold the two hollow parts in an axially fixed spaced apart relationship;

allowing the first hollow part to be pushed into the second hollow part for the protrusion to be received in the recess and the uncapped end of the first annular part to dislodge the punchable seal by removing the removable seal;

forming an annular part disposed around the outside of the second hollow part to define a second annular space between the annular part and the outside of the second hollow part; and forming threads extending around the inner diameter of the third annular part to engage a bottleneck in the second annular space and dispose the punchable seal within the bottle.

16. The method of claim 15, further comprising the step of scoring a line of weakness such that the uncapped end dislodges only a portion of the punchable seal.

17. The method of claim 15, further comprising the step of forming the uncapped end in an oval shape.

18. The method of claim 15, further comprising the step of forming the sealed reservoir cap from materials selected to prevent degradation of contents within the enclosed reservoir.

19. A method of providing a powder or liquid to a bottle using a sealed reservoir cap formed by the method of claim 15, comprising the steps of one selected from the group of sterilizing, filtering, pasteurizing and combinations thereof the contents of the bottle container prior to providing the sealed reservoir cap to the bottle.

20. The method of claim 19, comprising the step of mixing the released reservoir contents with the contents of the bottle.

21. The method of claim 19, comprising the steps of removing the sealed reservoir cap from the bottle and heating the contents of the bottle container prior to removal of the removable seal.

* * * * *